US008062271B2

(12) United States Patent
Harrison

(10) Patent No.: US 8,062,271 B2
(45) Date of Patent: Nov. 22, 2011

(54) BODY WASHING DEVICE

(76) Inventor: Tom Harrison, Warsaw, IL (US)

( * ) Notice: Subject to any disclaimer, the term of this patent is extended or adjusted under 35 U.S.C. 154(b) by 389 days.

(21) Appl. No.: 12/427,344

(22) Filed: Apr. 21, 2009

(65) Prior Publication Data

US 2010/0263686 A1 Oct. 21, 2010

(51) Int. Cl.
*A61M 35/00* (2006.01)

(52) U.S. Cl. ..... 604/290; 15/222

(58) Field of Classification Search ..... 604/289, 604/290; 15/222; 401/8; 601/143
See application file for complete search history.

(56) References Cited

U.S. PATENT DOCUMENTS

| | | | |
|---|---|---|---|
| 4,234,994 | A | 11/1980 | Schwab |
| 4,699,127 | A | 10/1987 | Schley |
| 5,072,480 | A | 12/1991 | Peters et al. |
| 6,209,165 | B1 | 4/2001 | Frolova |
| 6,223,382 | B1 | 5/2001 | Schwab |
| 6,656,565 | B2 | 12/2003 | Harrison |

*Primary Examiner* — Melanie Hand
(74) *Attorney, Agent, or Firm* — Cantor Colburn LLP

(57) ABSTRACT

A body washing device, a method for holding a washcloth using the body washing device, and a method for washing a body are provided. The body washing device includes first and second hand-held devices configured to hold a washcloth therebetween for easily cleaning portions of the body that are difficult to reach using only the washcloth.

10 Claims, 2 Drawing Sheets

BODY WASHING DEVICE

BACKGROUND OF INVENTION

A washcloth has been used to wash a person's body. However, when the person has limited mobility in their arms, the person may have difficulty in washing portions of their body with the washcloth.

Accordingly, the inventor herein has recognized a need for a body washing device that allows a person with limited mobility in their arms to wash portions of their body that would otherwise be difficult to reach using only a washcloth.

SUMMARY OF THE INVENTION

A body washing device in accordance with an exemplary embodiment is provided. The body washing device includes a first hand-held device having a first outer frame, a first inner frame, and a first retaining member. The first outer frame defines a first inner region. The first inner frame is disposed in the first inner region and is coupled to the first outer frame. The first inner frame defines a second inner region. The first retaining member is disposed in the second inner region and is coupled to the first inner frame. The first retaining member has a first aperture extending therethrough for receiving a first portion of a washcloth therein. The body washing device further includes a second hand-held device having a second outer frame, a second inner frame, and a second retaining member. The second outer frame defines a third inner region. The second inner frame is disposed in the third inner region and is coupled to the second outer frame. The second inner frame defines a fourth inner region. The second retaining member is disposed in the fourth inner region and is coupled to the second inner frame. The second retaining member has a second aperture extending therethrough for receiving a second portion of the washcloth therein.

A method for holding a washcloth on a body washing device in accordance with another exemplary embodiment is provided. The method includes disposing a first portion of the washcloth through a first gap between a first outer frame and a first inner frame of a first hand-held device. The method further includes disposing the first portion of the washcloth further through a first aperture of a first retaining member of the first hand-held device, such that the first retaining member holds the first portion of the washcloth thereon. The first retaining member is disposed within a first inner region defined by the first inner frame and is coupled to the first inner frame. The method further includes disposing a second portion of the washcloth through a second gap between a second outer frame and a second inner frame of a second hand-held device. The method further includes disposing the second portion of the washcloth further through a second aperture of a second retaining member of the second hand-held device, such that the second retaining member holds the second portion of the washcloth thereon. The second retaining member is disposed within a second inner region defined by the second inner frame and is coupled to the second inner frame.

A method for washing a body in accordance with another exemplary embodiment is provided. The method includes attaching a first portion of a washcloth to a first retaining member in a first inner frame of a first hand-held device. The method further includes attaching a second portion of the washcloth to a second retaining member in a second inner frame of a second hand-held device. The method further includes holding the first and second hand-held devices apart from one another such that a third portion of the washcloth is disposed between the first and second hand-held devices. The third portion of the washcloth is disposed between the first and second portions. The method further includes moving the first and second hand-held devices in a first direction such that the third portion of the washcloth contacts a portion of the body.

DETAILED DESCRIPTION EXEMPLARY EMBODIMENT

Figure 1:
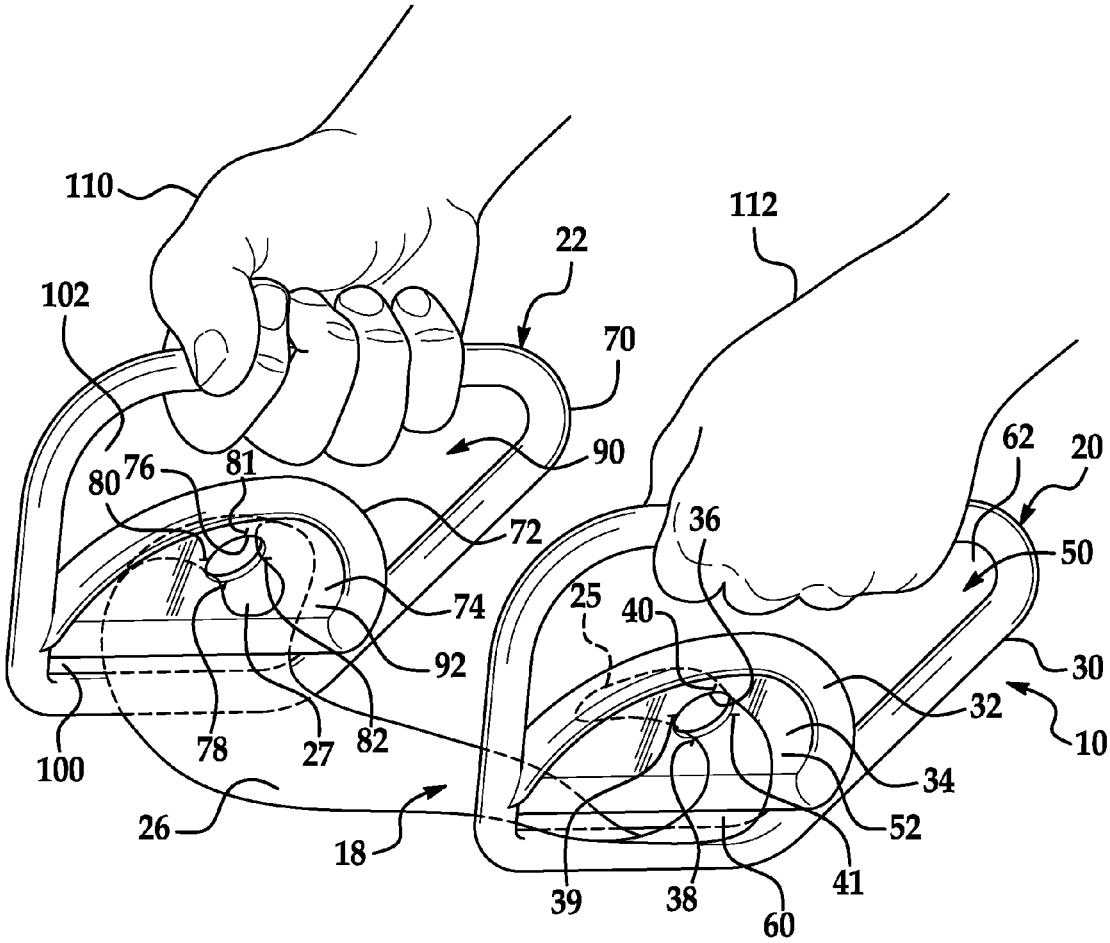
FIG. 1 is a schematic of a body washing device having first and second hand-held devices in accordance with an exemplary embodiment.
Figure 2:
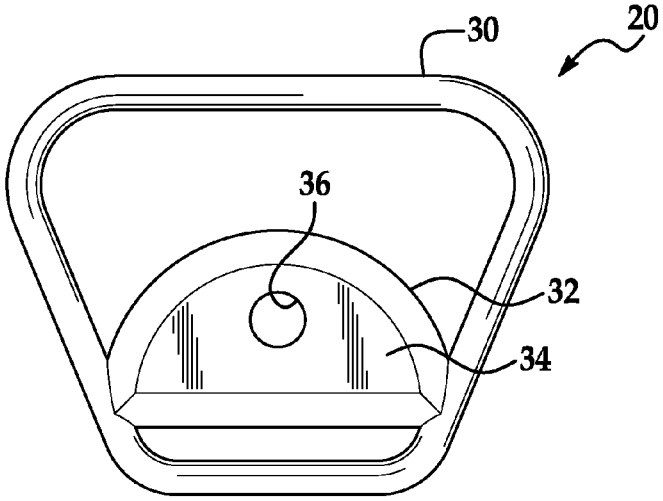
FIG. 2 is a schematic of the first hand-held device of FIG. 1.
Figure 3:
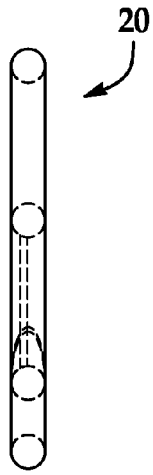
FIG. 3 is another schematic of the first hand-held device of FIG. 1.

Referring to FIGS. 1-3, a body washing device 10 for holding a washcloth 18 in accordance with an exemplary embodiment is illustrated. The body washing device 10 includes a hand-held device 20 and a hand-held device 22 configured to hold the washcloth 18 therebetween. An advantage of the body washing device 10 is that a person having limited arm mobility can utilize the hand-held devices 20, 22 to hold the washcloth 18 to wash portions of their body that they could not ordinary reach using only the washcloth 18. The washcloth 18 has portions 25, 26, 27 wherein portion 25 is attached to the hand-held device 20, and the portion 27 is attached to the hand-held device 22, and intermediate portion 26 is utilized to wash a human body, as will be explained in greater detail below.

The hand-held device 20 is provided to hold the portion 25 of the washcloth 18 thereon. The hand-held device 20 includes an outer frame 30, an inner frame 32, and a retaining member 34.

The outer frame 30 is configured to allow a person to grasp the hand-held device 20 in their hand 112. In one exemplary embodiment, the outer frame 30 has a noncircular ring shape and defines an inner region 50. Further, the outer frame 30 is constructed from plastic. Of course, in an alternative embodiment, the outer frame 30 could be constructed from other materials such as ceramic, wood, or metal composites.

The inner frame 32 is disposed in the inner region 50 and is coupled to the outer frame 30. In one exemplary embodiment, the inner frame 32 has a semicircular ring shape that defines an inner region 52. Further, the inner frame 32 is constructed from plastic. Of course, in an alternative embodiment, the inner frame 32 could be constructed from other materials such as ceramic, wood, or metal composites.

The retaining member 34 is a generally flat member disposed in the inner region 52 of the inner frame 32 and is coupled to the inner frame 32. The retaining member 34 is configured to hold a portion of the washcloth 26 thereon. As illustrated, the retaining member 34 has an aperture 36 extending therethrough and slots 38, 39, 40, 41 extending outwardly from the aperture 36. The aperture 36 is configured to receive the portion 25 of the washcloth 26 therein and has a diameter in a range of 0.5-1.0 inches for example. The slots, 38, 39, 40, 41 allow a person to wedge the washcloth 26 within the aperture 36 such that the washcloth 26 is held within the retaining member 34 while washing a portion of a body of the person. Further, the retaining member 34 is constructed from plastic. Of course, in an alternative embodiment, the retaining member 34 could be constructed from other materials such as ceramic, wood, metal composites, or rubber or a rubber compound.

A gap 60 is formed at a first end of the inner region 50 between the outer frame 30 and the inner frame 32 such that the portion 25 of the washcloth 26 is disposed through the gap 60 and then into the aperture 36 of the retaining member 34. Further, a gap 62 is formed at a second end of the inner region 52 between the outer frame 30 and the inner frame 32, such that the hand 112 of the person can grasp of the outer frame 30 and extend the hand 112 partially through the gap 62.

The hand-held device 22 is provided to hold the portion 27 of the washcloth 18 thereon. The hand-held device 22 includes an outer frame 70, an inner frame 72, and a retaining member 34.

The outer frame 70 is configured to allow a person to grasp the hand-held device 22 in their hand 110. In one exemplary embodiment, the outer frame 70 has a noncircular ring shape and defines an inner region 90. Further, the outer frame 70 is constructed from plastic. Of course, in an alternative embodiment, the outer frame 70 could be constructed from other materials such as ceramic, wood, or metal composites.

The inner frame 72 is disposed in the inner region 90 and is coupled to the outer frame 70. In one exemplary embodiment, the inner frame 72 has a semicircular ring shape that defines an inner region 92. Further, the inner frame 72 is constructed from plastic. Of course, in an alternative embodiment, the inner frame 72 could be constructed from other materials such as ceramic, wood, or metal composites.

The retaining member 74 is a generally flat member disposed in the inner region 92 of the inner frame 72 and is coupled to the inner frame 72. The retaining member 74 is configured to hold a portion of the washcloth 26 thereon. As illustrated, the retaining member 74 has an aperture 76 extending therethrough and slots 78, 79, 80, 81 extending outwardly from the aperture 76. The aperture 76 is configured to receive the portion 25 of the washcloth 26 therein and has a diameter in a range of 0.5-1.0 inches for example. The slots, 78, 79, 80, 81 allow a person to wedge the washcloth 26 within the aperture 76 such that the washcloth 26 is held within the retaining member 74 while washing a portion of a body of the person. Further, the retaining member 74 is constructed from plastic. Of course, in an alternative embodiment, the retaining member 74 could be constructed from other materials such as ceramic, wood, metal composites, or rubber or a rubber compound.

A gap 100 is formed at a first end of the inner region 90 between the outer frame 70 and the inner frame 72 such that the portion 27 of the washcloth 26 is disposed through the gap 100 and then into the aperture 76 of the retaining member 74. Further, a gap 102 is formed at a second end of the inner region 92 between the outer frame 70 and the inner frame 72, such that the hand 110 of the person can grasp of the outer frame 70 and extend the hand 110 partially through the gap 102.

Figure 4:
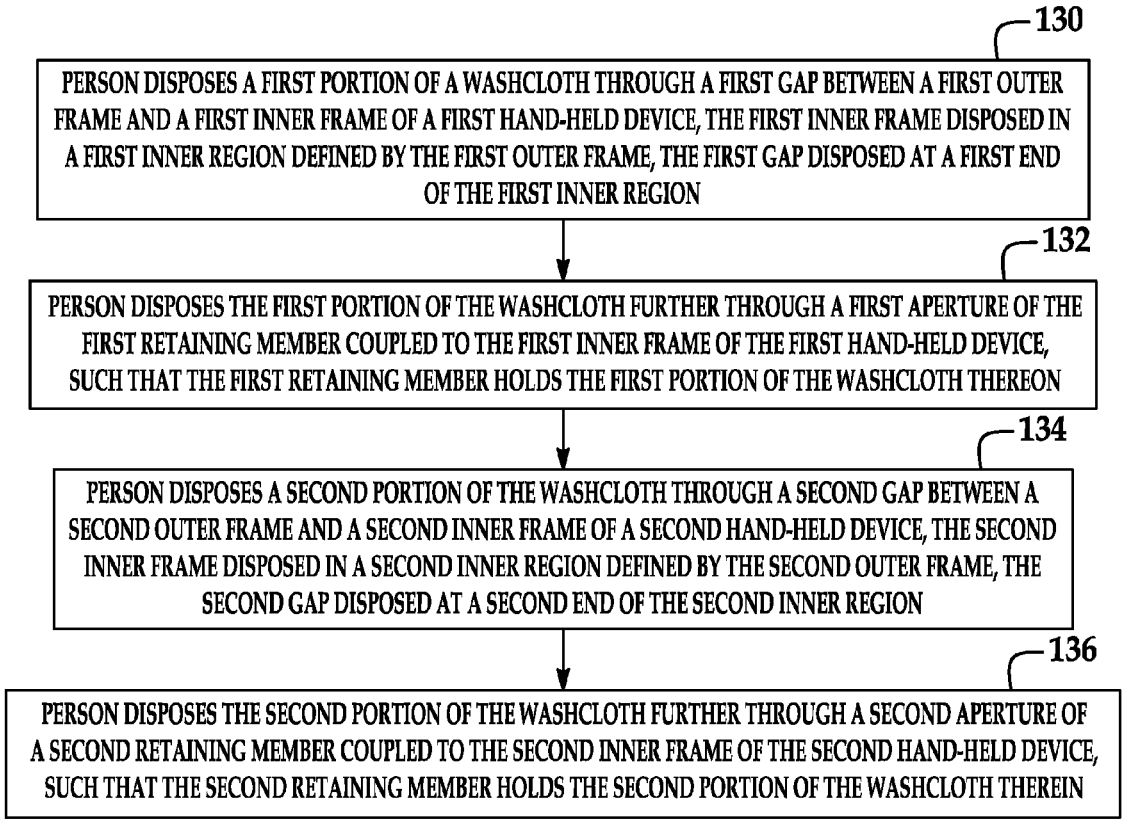
FIG. 4 is a flowchart of a method for holding a washcloth on the body washing device in accordance with another exemplary embodiment.

Referring to FIG. 4, a flowchart of a method for holding the washcloth 26 will be explained.

At step 130, a person disposes the portion 25 of the washcloth 18 through the gap 60 between the outer frame 30 and the inner frame 32 of the hand-held device 20. The inner frame 32 is disposed in the inner region 50 defined by the outer frame 30. The gap 60 is disposed at a first end of the inner region 50.

At step 132, the person disposes the portion 25 of the washcloth 18 further through the aperture 36 of the retaining member 34 coupled to the inner frame 32 of the hand-held device 20, such that the retaining member 34 holds the portion 25 of the washcloth 18 thereon.

At step 134, the person disposes the portion 27 of the washcloth 18 through a gap 100 between the outer frame 70 and the inner frame 72 of the hand-held device 22. The inner frame 72 is disposed in the inner region 90 defined by the outer frame 70. The gap 100 disposed at a second end of the inner region 90.

At step 136, the person disposes the portion 27 of the washcloth 18 further through the aperture 76 of the retaining member 74 coupled to the inner frame 72 of the hand-held device 22, such that the retaining member 74 holds the portion 27 of the washcloth 18 thereon.

Figure 5:
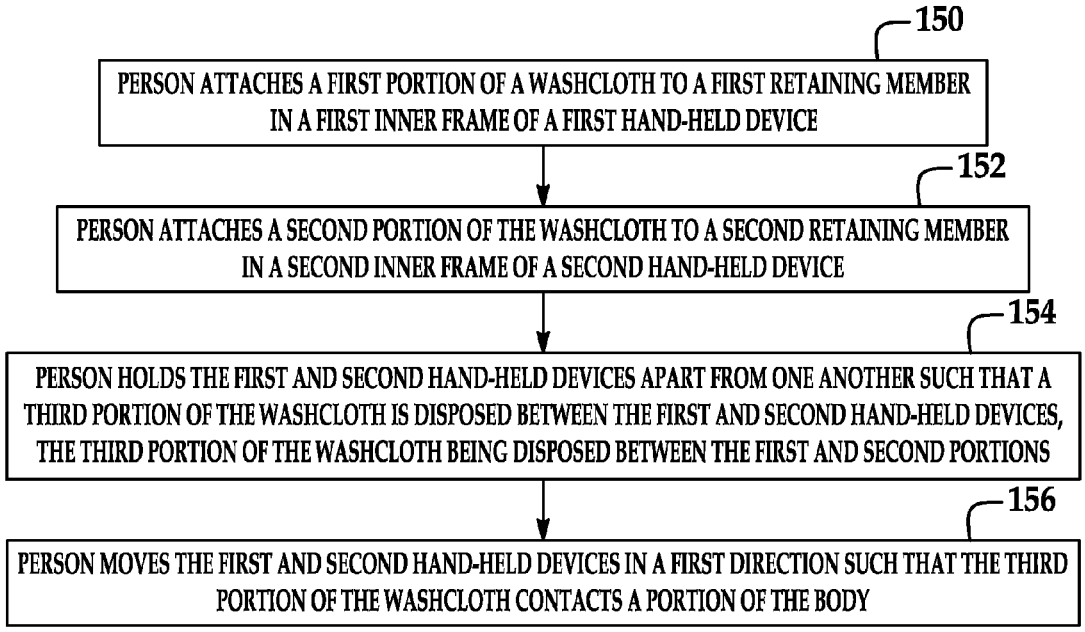
FIG. 5 is a flowchart of a method for washing a body in accordance with another exemplary embodiment.

Referring to FIG. 5, a flowchart of a method for washing a body of a person will now be described.

At step 150, a person attaches the portion 25 of the washcloth 18 to the retaining member 34 in the inner frame 32 of the hand-held device 20.

At step 152, the person attaches the portion 27 of the washcloth 18 to the retaining member 74 in the inner frame 72 of the hand-held device 22.

At step 154, the person holds the hand-held devices 20, 22 apart from one another such that the portion 26 of the washcloth 18 is disposed between the hand-held devices 20, 22. The portion 26 of the washcloth 18 is disposed between the portions 25, 27 of the washcloth 18.

At step 156, the person moves the hand-held devices 20, 22 in a first direction such that the portion 26 of the washcloth 18 contacts a portion of the body of the person to wash the portion of the body.

The body washing device and associated methods provide a substantial advantage over other devices and methods. In particular, the body washing device and methods provide a technical effect of allowing a user to hold a washcloth between first and second hand-held devices to allow the user to wash portions of their body that would be more difficult to wash using only the washcloth.

While the invention is described with reference to an exemplary embodiment, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited the embodiment disclosed for carrying out this invention, but that the invention includes all embodiments falling with the scope of the intended claims. Moreover, the use of the terms first, second, etc. does not denote any order of importance, but rather the terms first, second, etc. are used to distinguish one element from another.

What is claimed is:

1. A body washing device, comprising:

a first hand-held device having a first outer frame, a first inner frame, and a first retaining member, the first outer frame defining a first inner region, the first inner frame disposed in the first inner region and is coupled to the first outer frame, the first inner frame defining a second inner region, the first retaining member being disposed in the second inner region and is coupled to the first inner frame, the first retaining member having a first aperture extending therethrough for receiving a first portion of a washcloth therein; and a second hand-held device having a second outer frame, a second inner frame, and a second retaining member, the second outer frame defining a third inner region, the second inner frame being disposed in the third inner region and is coupled to the second outer frame, the second inner frame defining a fourth inner region, the second retaining member being disposed in the fourth inner region and is coupled to the second inner frame, the second retaining member having a second aperture extending therethrough for receiving a second portion of the washcloth therein.

2. The body washing device of claim 1, wherein the first hand-held device has a first gap disposed at a first end of the first inner region between the first outer frame and the first inner frame, such that the first portion of the washcloth is disposed through the first gap and then into the first aperture.

3. The body washing device of claim 2, wherein the first hand-held device has a second gap disposed at a second end of the first inner region between the first outer frame and the first inner frame, such that a hand of a person can grasp the first outer frame and extend the hand partially through the second gap.

4. The body washing device of claim 2, wherein the second hand-held device has a second gap disposed in the third inner region between the second outer frame and the second inner frame, such that the second portion of the washcloth is disposed through the second gap and then into the first second aperture.

5. The body washing device of claim 1, wherein the first outer frame is a generally non-circular ring.

6. The body washing device of claim 1, wherein the first outer frame, the first inner frame, and the first retaining member are constructed from plastic.

7. The body washing device of claim 1, wherein the first retaining member has slots extending outwardly from the first aperture.

8. The body washing device of claim 1, wherein the first aperture of the first retaining member has a diameter in a range of 0.5 to 1.0 inches.

9. A method for holding a washcloth on a body washing device, comprising:

disposing a first portion of the washcloth through a first gap between a first outer frame and a first inner frame of a first hand-held device;

disposing the first portion of the washcloth further through a first aperture of a first retaining member of the first hand-held device, such that the first retaining member holds the first portion of the washcloth thereon, the first retaining member being disposed within a first inner region defined by the first inner frame and is coupled to the first inner frame;

disposing a second portion of the washcloth through a second gap between a second outer frame and a second inner frame of a second hand-held device; and disposing the second portion of the washcloth further through a second aperture of a second retaining member of the second hand-held device, such that the second retaining member holds the second portion of the washcloth thereon, the second retaining member being disposed within a second inner region defined by the second inner frame and is coupled to the second inner frame.

10. A method for washing a body, comprising:

attaching a first portion of a washcloth to a first retaining member in a first inner frame of a first hand-held device;

attaching a second portion of the washcloth to a second retaining member in a second inner frame of a second hand-held device;

holding the first and second hand-held devices apart from one another such that a third portion of the washcloth is disposed between the first and second hand-held devices, the third portion of the washcloth being disposed between the first and second portions; and moving the first and second hand-held devices in a first direction such that the third portion of the washcloth contacts a portion of the body.

* * * * *